United States Patent [19]

Sprügel et al.

[11] Patent Number: 4,662,327

[45] Date of Patent: May 5, 1987

[54] PROCESS, APPARATUS AND AGENT FOR THE CONTINUOUS SUPPLY OF INTERNAL COMBUSTION ENGINES AND/OR AUXILIARY DEVICES THEREOF WITH ADDITIVES

[76] Inventors: Friedrich Sprügel, Solalindenstrasse 36 b, 8000 München 82; Manfred Köppel, Freibadstrasse 15, 8000 München 90, both of Fed. Rep. of Germany

[21] Appl. No.: 662,270

[22] Filed: Oct. 18, 1984

[30] Foreign Application Priority Data

Oct. 19, 1983 [DE] Fed. Rep. of Germany ..... 3337983

[51] Int. Cl.[4] ..... F02H 25/00

[52] U.S. Cl. ..... 123/198 A; 123/1 A; 123/25 E

[58] Field of Search ..... 123/25 E, 198 A, 1 A

[56] References Cited

U.S. PATENT DOCUMENTS

| | | | |
|---|---|---|---|
| 2,310,306 | 2/1943 | Miller et al. | 123/1 A |
| 2,720,869 | 10/1955 | Bevans | 123/1 A |
| 4,248,182 | 2/1981 | Malec | 123/1 A |
| 4,253,436 | 3/1981 | Dudrey | 123/198 A |
| 4,273,078 | 6/1981 | Cottell | 123/25 E |
| 4,335,684 | 6/1982 | Davis | 123/1 A |
| 4,388,893 | 6/1983 | Apfel | 123/25 E |
| 4,412,512 | 11/1983 | Cottell | 123/25 E |
| 4,438,731 | 3/1984 | Maggio | 123/25 E |

FOREIGN PATENT DOCUMENTS

| | | |
|---|---|---|
| 1256001 | 6/1968 | Fed. Rep. of Germany . |
| 7401479 | 1/1974 | Fed. Rep. of Germany . |
| 2411513 | 9/1975 | Fed. Rep. of Germany . |
| 3142800 | 6/1982 | Fed. Rep. of Germany . |

OTHER PUBLICATIONS

"Wer Kauft Die Katze Im Sack?," from the Journal Krafthand, vol. 44, Publication No. 18, pp. 999–1002 (Aug. 28, 1971).

*Primary Examiner*—Ira S. Lazarus

*Attorney, Agent, or Firm*—Workman, Nydegger & Jensen

[57] ABSTRACT

A process, an apparatus and an agent for the continuous supply of internal combustion engines and/or auxiliary devices thereof with additives are described, the additive being metered continuously into a line, in which an excess liquid operating agent of the combustion engine and/or the auxiliary device is returned to a supply tank.

9 Claims, 1 Drawing Figure

Figure 1:
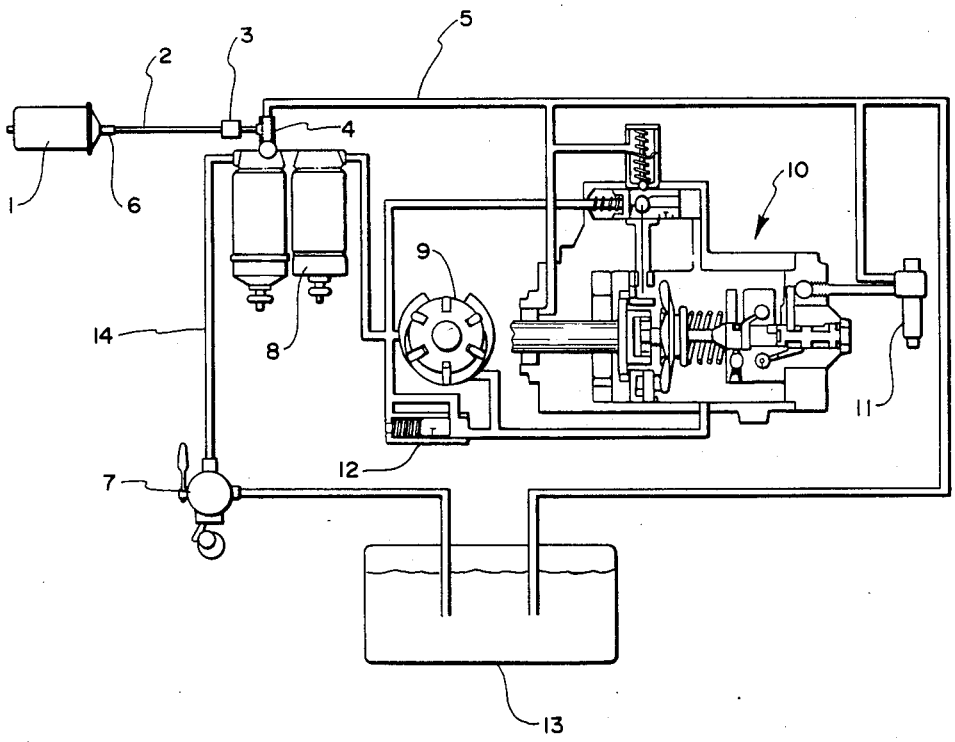

PROCESS, APPARATUS AND AGENT FOR THE CONTINUOUS SUPPLY OF INTERNAL COMBUSTION ENGINES AND/OR AUXILIARY DEVICES THEREOF WITH ADDITIVES

DESCRIPTION

The subject of the invention is a process for the continuous supply of internal combustion engines and/or auxiliary devices thereof with additives and an apparatus and an agent for the implementation of this process. Preferably, this process is applied to the supply with additives of internal combustion engines and auxiliary devices of motor vehicles.

It is customary to supply combustion engines and, in particular, engines and auxiliary devices of motor vehicles, such as cooling systems, brake systems, transmission, rear axles, differential gear and the like not only with the customary operating agents but also occasionally or constantly with additional additives in order to improve the operating characteristics of the engines or the auxiliary devices, or to restore them to their original performance level which has deteriorated due to wear, soiling and the like. It is customary in this respect to add additional additives to the operating agent concerned, such as the fuel, the lubricant, the radiator liquid or also the brake fluid or hydraulic fluid, which additives on the one hand improve the properties of the operating agent usually used and/or effect a cleaning, a corrosion protection of the devices coming into contact with this operating agent, achieve a sealing of the radiator system, effect an improvement in the octane number or in the lubricating behavior and so forth. In this case, the additives are usually added in a single process to the operating agent concerned, such as the fuel, the lubricating oil, the radiator liquid, the brake fluid and/or the hydraulic fluid. Problems arise in this procedure due to the fact that frequently only inadequate mixing of the additive with the operating agent concerned is achieved, that the addition is only made occasionally and is often forgotten by the operator of the motor vehicle and that a selective and, in particular, continuous metering of the additive is not possible.

On the other hand, lubrication apparatuses for combustion engines, with which a lubricant is fed to the fuel before entry into the carbureter or into an injection device, are known from German Utility Model No. 7,401,479 and German Offenlegungsschrift No. 2,411,513. According to the teaching of German Utility Model No. 7,401,479, the oil line coming from an oil delivery device opens into the fuel line, a non-return valve being provided at the opening of the oil line, in the form of an extendable hose membrane closing the opening. German Offenlegungsschrift No. 2,411,513, on the other hand, makes possible feeding of the lubricant as a function of operating parameters of the combustion engine via an electromagnetically controlled metering and mixing valve. These already known lubricating devices suffer from the disadvantage that the lubricant has to be introduced into the pressurized fuel directly upstream of the carbureter or injection pump, which is a mechanically complex procedure and is accompanied by difficulties in mixing the lubricant with the fuel, especially when the lubricant dissolves only poorly in the fuel.

The object of the present invention is therefore to provide a process, an apparatus and an agent with which it is possible to supply internal combustion engines and/or auxiliary devices therefor continuously with additives in a simple way and without difficulties occurring due to inadequate mixing of the additive with the operating agent concerned, and which process can be implemented multifariously without great expenditure.

This object is achieved by the process according to the present invention wherein the additive is continuously metered into a line in which an excess fluid operating agent is returned to a supply tank of the combustion engine and/or the auxiliary device.

Thus, according to the teaching of the present invention and contrary to the teaching of the publications mentioned above, the additive is not added to the fuel before entry into the carbureter or into the injection device, but the additive is instead fed in the existing return line of the operating agent concerned, for example in the fuel return line, as a result of which the returned operating agent with added additive is first returned again to the supply tank, for example the fuel tank, and only from there is fed for its intended use, for example to the carbureter or the injection device. In this way, not only is a good, complete mixing or dissolution of the additive with the operating agent achieved, but the additive is also enabled to exhibit its aimed effects in the return line and the supply tank as well. Furthermore, feeding the additive is quite substantially facilitated as the pressure in the return line is considerably lower than that in the operating agent feed line.

According to a preferred embodiment of the invention, the additive, in the form of a preparation of liquid or pasty consistency, is forced continuously under slight overpressure at a constant rate per unit of time via a non-return valve into the operating agent return line. In this way, additive addition is performed constantly over time and independently of the returned amount of operating agent. This means that, in the case of relatively long intervals between operation of the internal combustion engine, actually a higher additive concentration is caused in the operating agent tank, which is advantageous especially in the high-wear stop-and-go operation of motor vehicles, where relatively long stopping times alternate with short periods of operation, which makes a higher amount of additive necessary at the point of action due to the naturally high wear. Since, as is known, motor vehicles have particularly high wear in stop-and-go traffic with frequent cold starts, in this way there is a particularly high supply of the required additive to the internal combustion engine. This makes it possible to prevent or to reduce the undesired increased wear, corrosion, formation of acids and resinous deposits permanently and effectively, so that the problems can be avoided which occur in the conventional, intermittent addition of the additive to the operating agent concerned and are affected by the forgetfulness of the vehicle owner.

However, according to a further embodiment of the invention, it is also possible to control the amount of additive as a function of the amount of operating agent returned through the operating agent return line, for example electromechanically, pneumatically or in a simple way via the solubility behavior of the additive or of the additive preparation in the operating agent. Preferably used for this purpose is an additive preparation which dissolves slowly in the operating agent and from which the desired additive is dissolved out by the operating agent flowing past, to be precise to a selfcontrolled extent dependent on the amount of operating agent flowing past. In this way, the amount of additive metered in is that much greater the greater the throughput of operating agent is over time through the operating agent return line, which is the case for example in the stop-and-go operation of motor vehicles where brief starting processes alternate with idle stopping times. Since larger amounts of operating agent per unit of time are returned through the operating agent return line to the tank when the engine is idling, an increased additive uptake by the operating agent is effected at this moment, thereby increasing the concentration of the additive in the tank, which is advantageous in this type of operation of the internal combustion engine. In this way, it is likewise possible to compensate for the harmful effects of stop-and-go operation or of frequent cold starts.

According to the invention, the necessary additives can be fed to any desired operating agents of an internal combustion engine and/or the auxiliary devices thereof, preferably the engine or the auxiliary units of a motor vehicle, for example the fuel, the lubricant, the coolant and the brake or hydraulic fluid. Any known active substances can be used as additives for this purpose. For example, the fuel of the engine can have added an added lubricant, a flow improver, an agent for cleaning the tank, the lines, the carbureter or the injection pump, the combustion chambers of the engine, the valves, the valve seats and the piston rings, an agent for the reduction of soot or for improving the exhaust emission, an agent for increasing the service life of exhaust catalysts or elese an agent for improving the octane number. Particularly advantageous is the claimed procedure for the antifreeze protection of diesel fuel, which has the tendency at low temperatures of separating out paraffin, which blocks the fuel lines, filters and the injection system. With the aid of the process according to the invention, a flow improver or an antifreeze concentrate can be introduced into the diesel fuel at the start of the cold period following the claimed procedure, whereby the required antifreeze protection is achieved without having to add, in the conventional way, gasoline, petrol or antifreeze whenever filling the tank or having to ensure that winter diesel fuel is used for refuelling.

According to the invention, it is also possible to add in the claimed way an additive to the radiator liquid, for example an agent for the prevention of corrosion and of the formation of deposits in the cooling system, a refrigerator sealant, a lubricant for the devices through which the coolant flows, such as water pump, thermostat and heating and/or an antifreeze. In this mode of operation, the additive is metered into the return line of the cooling system of the vehicle engine to a supply tank.

Of course, it is also possible to feed an additive to the return line of the brake system or of a central hydraulic system to a supply tank following the claimed procedure, for example an agent for maintaining the function of the brake or hydraulic fluid, an agent for cleaning and for corrosion protection of the brake system or of the hydraulic system.

Finally, it is also possible to introduce an additive into the return line of the lubricating system or systems of engine, transmission, differential gears of the motor vehicle to a supply tank, for example an extreme-pressure lubricant, a viscosity index improver, a cleaning agent and/or a corrosion protection agent. It goes without saying that the claimed procedure can also be applied to stationary combustion engines and similar devices of this type, in which an additive can be added via a liquid operating agent.

According to a preferred embodiment of the process according to the invention, the additive is used in the form of an additive preparation, which is completely or substantially completely soluble in the operating agent to be treated. In this case, it is possible in an advantageous way to control the amount of additive via the overpressure applied upon introduction into the operating agent return line, the consistency, the composition and the solubility of the additive or the additive preparation.

Preferably, according to the invention, the additive or the additive preparation is introduced continuously into the operating agent return line mechanically, pneumatically, hydraulically, by spring force and/or by gas formation, with the aid of a metering device. A metering device of the type known for lubricants from German Patent Specification No. 1,256,001 is used advantageously for this purpose. This lubricant box, discharging lubricant automatically, has a closed, extendable body and a chamber filled with lubricant, a device for the formation of gas, consisting of a galvanic element and engageable at any required moment, being provided in the closed, extendable body, which gas builds up a pressure in the extendable body, by means of which the latter extends daily by a certain amount and by means of which lubricant is fed from the chamber filled with lubricant via a lubricant channel to a lubricating point. With this commercially available lubricant box, it is possible to feed the lubricant continuously to the lubricating point at a metered, constant rate over several months. According to the invention, instead of the lubricant, the additive or the additive preparation is fed and, in the same way, added continuously to the operating agent to be treated at a constant amount over time over several months. In this way, it is possible to renew the metering device during routine maintenance, so that the possibility of the vehicle owner forgetting to add additive is largely excluded and continuous operating conditions are ensured.

The apparatus of the present invention for the implementation of the claimed process comprises a metering device containing the additive or the additive preparation and a feed line provided with a non-return valve and connectable to the operating agent return line via a connecting piece. Preferably, the metering device is fixed detachably to the line via a screwed connection, facilitating replacement of the used metering device by a new one. Furthermore, it is also advantageous to combine the screwed connection, the line, the non-return valve and the connecting piece in a single component, saving expense, materials and weight and making installation easier.

The apparatus according to the invention preferably comprises a metering cartridge of the commercially available, abovementioned lubricant box type. Instead of discharging lubricant automatically, however, an additive of the required consistency is provided, which is introduced continuously into the operating agent return line at a constant rate over time due to the chemical reaction in the closed, extendable body.

A further subject of the invention is an agent for the implementation of the process, namely an additive preparation which is soluble in the operating agent to be treated and made up from one or more additives of the type mentioned above, one or more solvents for the additive and the operating agent concerned and one or more thickeners for adjustment of the desired consistency. Preferably, this thickener is likewise soluble in the operating agent concerned.

The invention is explained in more detail below with reference to the attached drawing, in which the FIGURE shows the fuel injection system of a motor vehicle.

As can be seen from the FIGURE, the fuel is pumped with the aid of the fuel pump 7 from the fuel tank 13 via the fuel feed line 14 into the fuel filters 8. From there, the fuel is passed via the vane pump 9 into the injection pump 10, from where the fuel is injected via the injection nozzle 11 into the combustion chamber of the engine. The excess fuel is returned via the fuel return line 5 into the fuel tank 13, the returned amount also being influenced by the pressure control valve 12.

At the fuel return line 5, the apparatus according to the invention is fixed via the connecting piece 4, in this case the piece concerned being a simple T-piece. Between the connection piece 4 and the line 2 is the nonreturn valve 3, which prevents the fuel from getting into the metering device 1 from the return line 5 or, should this device fail or be removed, from emerging from line 2. The metering device 1 is joined to line 2 via the screwed connection 6. This line 2 is preferably combined together with non-return valve 3 and connecting piece 4 in a single component. In principle, the metering device 1 is of the same design as the abovementioned lubricant box, discharging lubricant automatically, known from German Patent Specification No. 1,256,001, but instead of the lubricant described there contains the additive or the additive preparation used according to the invention.

During operation of the engine, excess fuel flows through the fuel return line 5, which fuel takes up additive fed from the metering device 1 via the line 2, the non-return valve 3 and the connecting piece 4 and passes it into the fuel tank. In this way, it is accomplished that, during operation of the engine, the additive or the additive preparation is constantly passed to the tank and, from there, introduced via the fuel feed line 14 into the engine, where the additive exhibits its desired effect. Of course, the cleaning and/or corrosion protection agent used in this case also has its effect in the fuel tank 13 and in the devices connected thereto, up to and including the exhaust of the engine.

Since the amount of additive is introduced into the fuel flowing through the fuel return line 5 at a constant rate over time, a lower addition of additive per unit of time results at higher fuel consumption as a lower amount of fuel is returned through the return line due to the higher consumption. Conversely, there is a higher addition of additive at lower fuel consumption. This undoubtedly represents a considerable advantage in preventing continuously and effectively the higher wear, more intensive corrosion and greater soiling occurring, for example, in stop-and-go traffic. In this way, the amount of additive throughout involved is constant and independent of the momentary fuel consumption of the engine. However, if at the same return rate, less fuel is actually consumed over a prolonged period, which generally occurs in stop-and-go traffic, a relatively large amount of additive accumulates in the tank and in the overall system during the course of time. Thus, it is known that motor vehicles in stop-and-go traffic and with frequent cold starts have a particularly high consumption for this range, which, when using the process according to the invention, has the effect of a higher supply of additive so that in this way the increased wear, corrosion, formation of acids and resinous deposits in the engine and the auxiliary devices can be prevented or reduced permanently and effectively.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for continuously supplying a fuel additive to an internal combustion engine system, the system comprising a fuel to power the internal combustion engine, a fuel supply tank for containing said fuel, means for transporting said fuel from the fuel supply tank to the engine, and a fuel return line for returning excess fuel from the engine to said fuel supply tank, the method comprising the steps of:

positioning a fuel additive metering device in communication with said fuel return line, said fuel additive metering device serving to continuously release a controlled amount of said fuel additive into said fuel return line; and circulating said fuel through said internal combustion engine system during the operation of said system, said fuel serving to carry said fuel additive through said system.

2. A method as defined in claim 1 further comprising the step of positioning a non-return valve between said fuel additive metering device and said fuel return line, said non-return valve serving to allow said fuel additive to flow from said fuel additive metering device into said fuel return line under slight pressure at a constant rate per unit time while substantially preventing fuel within said fuel return line from entering said fuel additive metering device.

3. A method as defined in claim 1 wherein said fuel additive is in the form of a liquid preparation.

4. A method as defined in claim 1 wherein said fuel additive is soluble in said fuel.

5. A method as defined in claim 1 wherein the amount of fuel additive released into said fuel return line is controlled as a function of the quantity of fuel flowing through said fuel return line.

6. An apparatus for continuously supplying a fuel additive to an internal combustion engine system, the system comprising a fuel, a fuel tank for said fuel, means for introducing saif fuel through said system, and a fuel return line for returning excess fuel from said system to said tank, the apparatus comprising:

a fuel additive metering device positioned in communication with said fuel return line, said fuel additive metering device being capable of releasing a controlled amount of said fuel additive into said fuel return line;

a feed line connecting said fuel additive metering device with said fuel return line; and a non-return valve positioned along said feed line between said fuel additive metering device and said fuel return line, said non-return valve being capable of allowing said fuel additive to flow from said fuel additive metering device into said return line at a constant rate per unit time while substantially preventing fuel within said fuel return line from entering said fuel additive metering device.

7. An apparatus as defined in claim 6 wherein said feed line is connected to said fuel additive metering device by a screwed connection.

8. An apparatus as defined in claim 7 further comprising a connecting piece to connect said feed line to said fuel return line.

9. An apparatus as defined in claim 8 wherein said connecting piece, said non-return valve, said feed line, and said screwed connection are combined into a single component.

* * * * *